US007332005B2

(12) United States Patent
Wegelin

(10) Patent No.: US 7,332,005 B2
(45) Date of Patent: Feb. 19, 2008

(54) FILTRATION BAG REPLACEMENT SYSTEM FOR A FLOOR CARE APPLIANCE

(75) Inventor: Jackson W. Wegelin, Akron, OH (US)

(73) Assignee: The Hoover Company, North Canton, OH (US)

( * ) Notice: Subject to any disclaimer, the term of this patent is extended or adjusted under 35 U.S.C. 154(b) by 533 days.

(21) Appl. No.: 10/376,379

(22) Filed: Feb. 28, 2003

(65) Prior Publication Data

US 2004/0168280 A1 Sep. 2, 2004

(51) Int. Cl.
*A47L 5/38* (2006.01)

(52) U.S. Cl. ..... 55/373; 55/DIG. 2; 55/DIG. 3; 15/314; 15/315; 15/323; 15/352

(58) Field of Classification Search ..... 55/361, 55/367, 369, 378, DIG. 2, DIG. 3, 373; 15/347, 15/352, DIG. 8, 314, 315, 323
See application file for complete search history.

(56) References Cited

U.S. PATENT DOCUMENTS

| | | | | |
|---|---|---|---|---|
| 2,497,581 | A | 2/1950 | Brown, Jr. | |
| 2,532,642 | A | 12/1950 | Senne | |
| 2,564,467 | A | 8/1951 | Cranmer | |
| 2,649,926 | A | 8/1953 | Granmer | |
| 2,758,667 | A | 8/1956 | Brace | |
| 3,873,285 | A | 3/1975 | Allen | |
| 4,545,794 | A | 10/1985 | Himukai | |
| 6,379,408 | B1 * | 4/2002 | Embree et al. | 55/361 |
| 6,450,088 | B1 * | 9/2002 | Hutchinson | 100/320 |
| 6,502,274 | B1 * | 1/2003 | Harrelson, II | 15/314 |
| 6,560,816 | B1 * | 5/2003 | Harrelson, II | 15/314 |
| 2004/0020913 | A1 * | 2/2004 | Hovorka | 219/243 |

FOREIGN PATENT DOCUMENTS

| | | |
|---|---|---|
| CA | 481360 | 7/1946 |
| EP | 0 322 387 | 6/1989 |
| EP | 0 835 631 A2 | 4/1998 |
| WO | WO 99/33387 | 7/1999 |
| WO | 03/075732 A1 | 9/2003 |

* cited by examiner

*Primary Examiner*—Duane Smith
*Assistant Examiner*—Minh-Chau T. Pham
(74) *Attorney, Agent, or Firm*—A. Burgess Lowe; Michael J. Corrigan

(57) ABSTRACT

A floor care appliance such as a vacuum cleaner is provided having an filtration bag changing assembly located in the filtration compartment. A supply of filtration material is packaged in a container in the form of a continuous tube to be fed into the filtration compartment. A sealing and cutting assembly seals the tube at the lower end after a bag is fed into the filtration compartment. Once a filtration bag is full, a new filtration bag is pulled into place with the lower end of the tube being sealed and the old filtration bag being cut from the tube by a cutter. A pair of opposing heating elements are used to seal the opposing sidewalls of the tube together to form the filtration bag. The free end of the tube is fluidly connected to the suction nozzle by a connector and a dirt duct.

7 Claims, 6 Drawing Sheets

FILTRATION BAG REPLACEMENT SYSTEM FOR A FLOOR CARE APPLIANCE

BACKGROUND OF THE INVENTION

1. Field of the Invention

This invention relates to floor care, and more specifically, to a floor care appliance having a filtration bag changing apparatus contained in the filtration compartment.

2. Summary of the Prior Art

Floor care appliances are well known in the art. Typical floor care appliances include upright vacuum cleaners, canister vacuum cleaners, hard floor cleaners, and extractors. It is known to provide floor care appliances with a filtration bag for filtering and collecting dirt particles. Typically, when the filtration bag is full it is removed from the filtration housing and discarded. A new filtration bag is inserted in the filtration housing and connected to the suction duct. Several filtration bags are usually packaged and sold together.

It is known on the art to provide a suction cleaner with an automated means to replace the filtration bag. In U.S. Pat. No. 2,532,642, a suction cleaner has several filtration bags prepackaged in a box like container and loaded on a carriage in a magazine for ready installation in the filtration compartment of the suction cleaner. Once the current filtration bag is full, a filtration bag ejection button can be pressed to eject the full filtration bag and cause a new filtration bag to be installed. The new filtration bag is installed by a system of gears and levers which position the filtration bag into place followed by a blast of air which ejects the filtration bag from box the bag compartment and inflates it.

However, this system is quite cumbersome and requires many parts to operate. It would not fit into the filtration compartment of a typical floor care appliance such as an upright vacuum cleaner. Therefore, there exists a need in the art for a less cumbersome and simple filtration bag changing apparatus that can be installed in the filtration compartment of a floor care appliance. The present invention fulfills this need by providing a filtration bag changing apparatus comprised of a continuous tube of filtration material packed into a dispensing container which sits on top of and feeds into the filtration compartment. The continuous tube supplies filtration material for a plurality of filtration bags before requiring replacement. The free end is initially sealed as supplied to form an initial volume wherein particles are filtered and collected. The opposite end of the tube is still packed into the dispensing container with the open end of the tube in fluid communication with the suction duct delivering dirt particles to the filtration compartment. Once the first portion of the tube containing the initial volume is full of dirt particles, the sealed end of the tube is pulled downward and out of the filtration compartment. At the same time, another portion of the tube is pulled into the filtration compartment. Once the appropriate amount of the tube is pulled into the filtration compartment and the full portion of the tube has exited the filtration compartment, a heat sealer seals the top of the full portion of the tube and the now open end at bottom of the remaining portion of the tube. A cutter then cuts the top end of the full portion of the tube or "old bag" from the bottom end of the remaining portion of the tube or the "new" bag. This process is repeated until the last filtration bag is pulled into place.

Accordingly, it is an object of the invention to provide an improved floor care appliance having a filtration bag changing apparatus.

It is yet further an object of this invention to provide an improved floor care appliance having supply of filtration material for forming a plurality of filtration bags.

It is yet even further an object of this invention to provide an improved floor care appliance having a plurality of prepackaged filtration bags formed from a continuous tube.

SUMMARY OF THE INVENTION

In the preferred embodiment of the invention, a filtration bag changing apparatus comprised of a continuous tube of filtration material packed into a dispensing container which sits on top of and feeds into the filtration compartment. The continuous tube supplies filtration material for a plurality of filtration bags before requiring replacement. Initially the free end of the tube is sealed so an initial volume is formed in the tube for filtering collecting particles. The opposite end of the tube is still packed into the dispensing container with the open end of the tube in fluid communication with the suction duct delivering dirt particles to the filtration compartment volume in the tube. Once the initial volume within the tube is full of dirt particles, the sealed end of the tube is pulled downward until the volume has exited the filtration compartment. At the same time, another portion of the remaining portion of the tube is pulled into the filtration compartment. Once the full portion of the tube has exited the filtration compartment, a sealer seals the top of the now full portion of the tube or "old bag" and the bottom of remaining portion of the tube or the "new" bag. A cutter cuts the top end of the full portion of the tube or "old bag" from the bottom end of the remaining portion of the tube or "new bag". This process is repeated until the last filtration bag is pulled into place.

BRIEF DESCRIPTION OF THE DRAWINGS

Reference may now be had to the accompanying drawings for a better understanding of the invention, both as to its organization and function, with the illustration being only exemplary and in which.

DETAILED DESCRIPTION OF THE INVENTION

Figure 1:
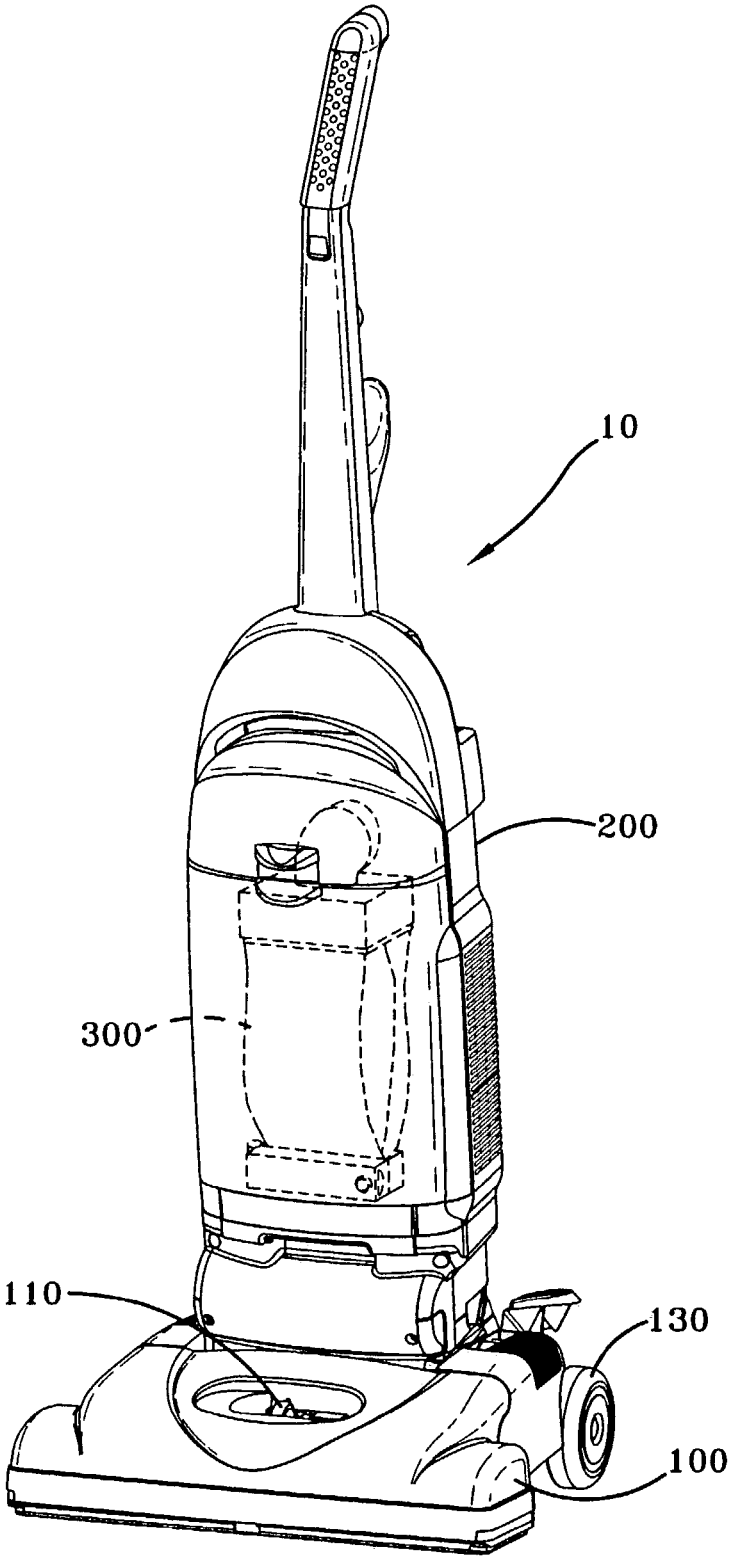
FIG. 1 is a perspective view of an upright vacuum cleaner having a filtration bag changing apparatus located in the filtration compartment, according to the preferred embodiment of the present invention.
Figure 2:
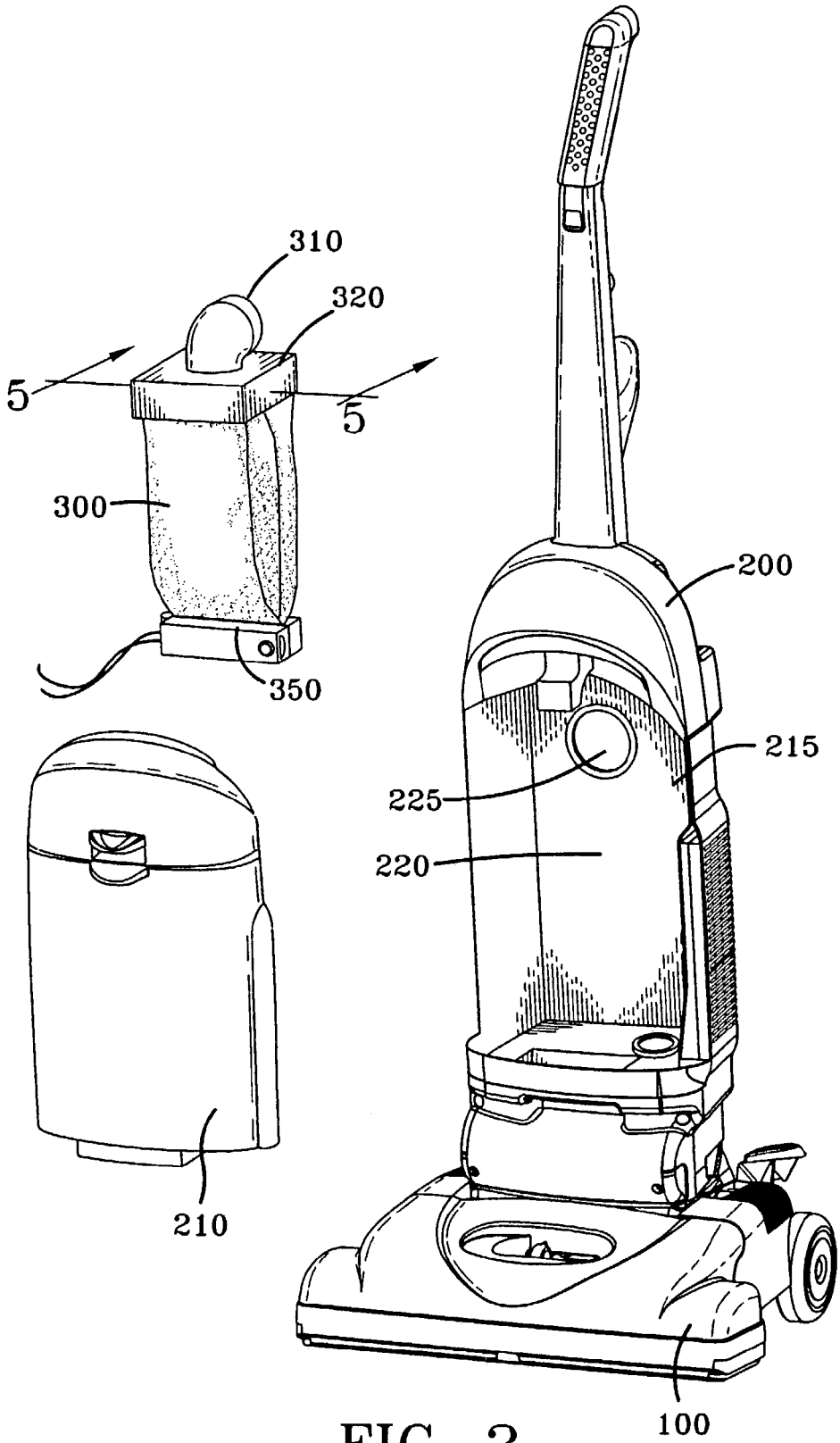
FIG. 2 is a perspective view the upright vacuum cleaner of FIG. 1 with the filtration compartment cover removed and the filtration bag changing apparatus removed from the filtration compartment, according to the preferred embodiment of the present invention.
Figure 3:
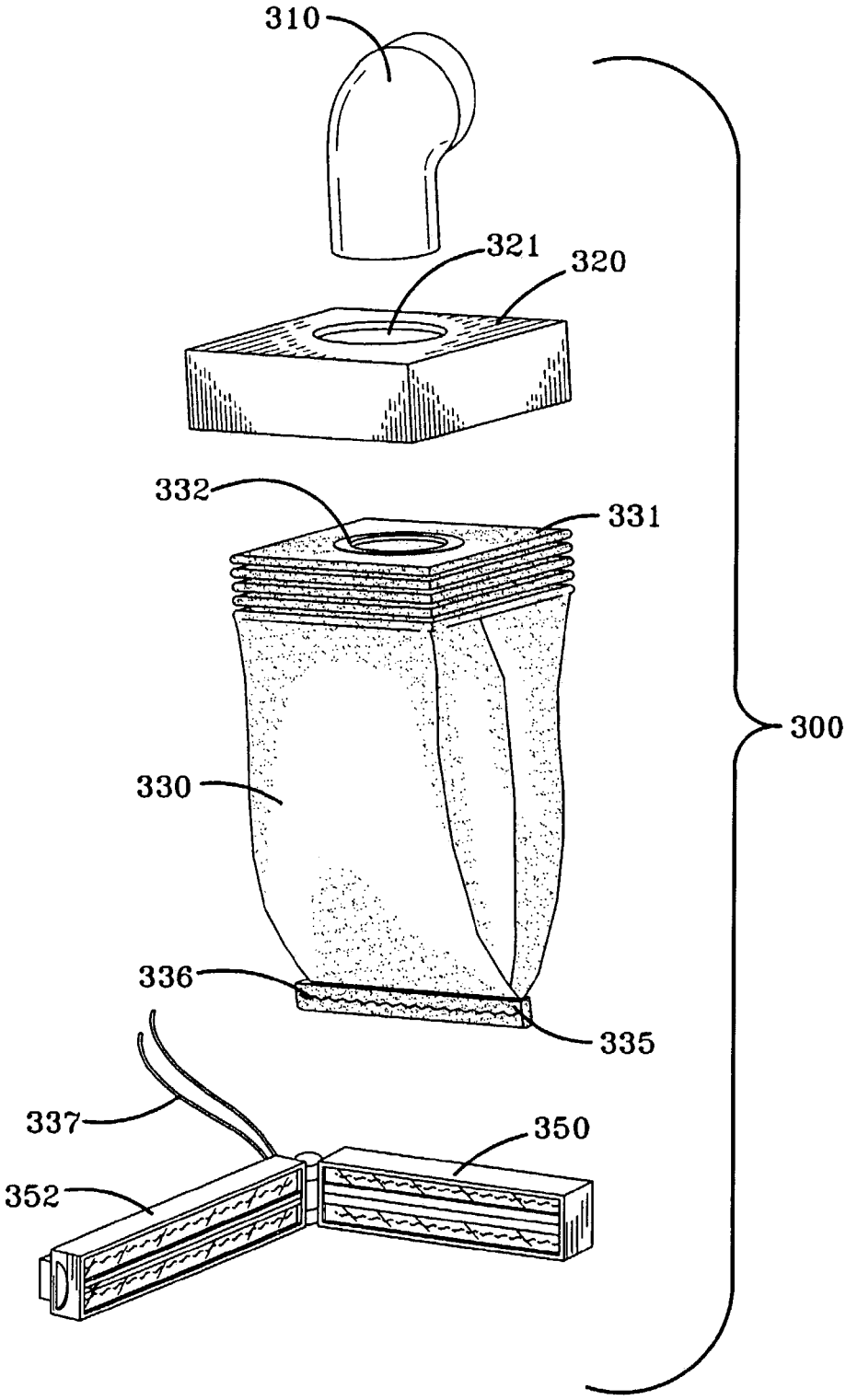
FIG. 3 is an exploded perspective of the filtration bag changing apparatus shown in FIG. 2, according to the preferred embodiment of the present invention.
Figure 4:
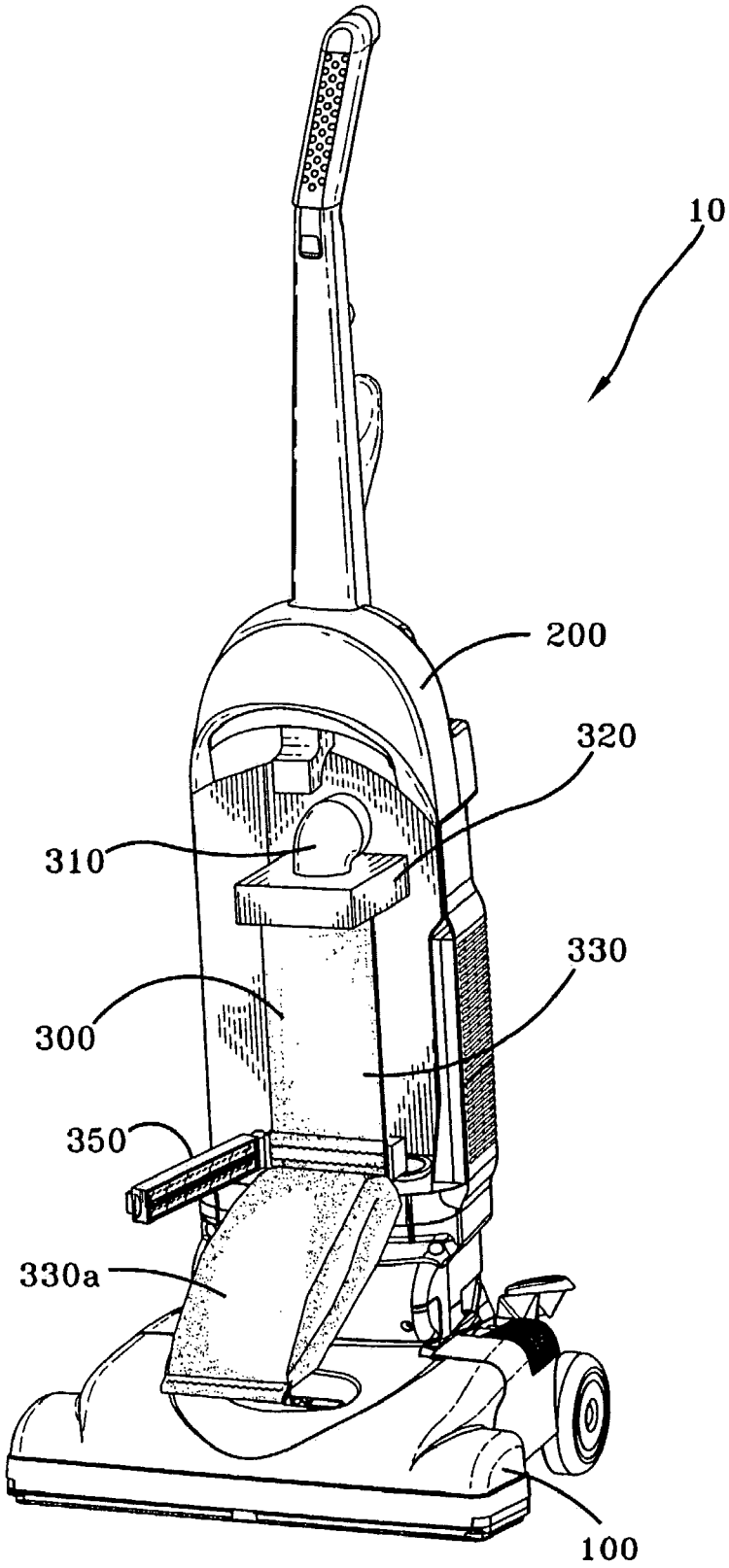
FIG. 4 is a perspective view of the upright vacuum cleaner of FIG. 1 with the filtration compartment cover removed and the filtration bag changing apparatus installed in the filtration compartment wherein the cutting and sealing assembly is in the open position and a full filtration bag in the position just prior to being cut from the continuous tube of filtration material, according to the preferred embodiment of the present invention.

Referring now to FIG. 1, shown is an upright vacuum cleaner 10 having filtration bag changing system 300, according to the preferred embodiment of the invention. Upright vacuum cleaner 10 includes a foot 100 and an upper housing assembly 200 pivotally connected to foot 100. Foot 100 is similar to those known in the art and includes a nozzle opening (not shown) for receiving a stream of dirt-laden air and an agitator (not shown) for agitating and loosening dust and debris from a floor surface when upright vacuum cleaner 10 is in the floor care mode. Foot 100 further includes a pair of front wheels (not shown) rotatably mounted on a wheel carriage (not shown), and a pair of rear wheels 130. A height-adjustment knob 110 is positioned on foot 100 for adjusting the height of the nozzle opening (not shown) relative to the floor surface.

Located in foot 100 or upper housing 200 is a motor-fan assembly (not shown) which creates the suction necessary to remove the loosened dust and debris from the floor surface. The motor-fan assembly (not shown) fluidly connects to foot or suction nozzle 100 by a dirt duct (not shown). The upper housing assembly 200 houses a particle filtration and collecting system 300 for receiving and filtering the dirt-laden air stream which is created by the motor-fan assembly (not shown). The particle filtration and collecting system 300 may be interposed in the dirt laden airstream between the suction nozzle 100 and the motor-fan assembly (not shown) as in an "indirect air" system or the motor-fan assembly may be interposed between the suction nozzle 100 and the particle filtration and collecting system 300 as in a "direct air" system.

Referring now to FIGS. 2 through 5, the upper housing assembly 200 includes a rear housing portion 215 which forms the filtration compartment 220 for receiving the particle collecting and filtration assembly 300, a door 210 which encloses the filtration compartment 220. Essentially the particle collecting and filtration assembly 300 is comprised of a filtration bag cartridge or container 320 prepackaged with a plurality of partially formed filtration bags in the form of a continuous tube 330. One end of the tube 330 is initially sealed at the factory and the tube 330 is formed of at least an inner and outer layer of a known or heretofore unknown filtration media. The inner layer is a filtration media having a lower melting temperature than the outer layer for the reasons described below. The tube 330 is packed in the container 320 such that the tube 330 is compressed until pulled from within the container 320. The container 320 is installed at the upper end of the filtration compartment 220 such that the open end of the container 320 is downwardly disposed. In this manner, the initially sealed end of the tube 330 can be pulled so that a portion of tube 330 can be pulled into the filtration compartment 220. The interior of the portion of tube 330 now in the filtration compartment 220 forms an initial volume wherein particles from the dirt laden airstream are directed for filtering and collection. The opposing end of tube 330 remains open and fluidly connected to a suction nozzle 100. The opposing end is fixed about a downwardly disposed connecting tube 310 projecting downwardly into the container 320. The connecting tube 310 is hollow to allow the particle laden airstream to pass into the opposing or open end of the tube 330 into the volume located beneath the container 320. The remainder of the unused portion of the tube 330 remains compressed in the container 320 packed around the connecting tube 310. The filtration compartment 220 may be negatively pressurized to cause a negative pressure within the volume to draw in the particle laden airstream as in an "indirect air" system or the particle laden airstream may be blown into the volume as in a "direct air" system.

After the initial volume is filled with particles, as can be determined by manual or automatic means, the filtration compartment cover 210 and sealing and cutting assembly cover 352 are opened so that the full portion of the tube 330 containing the initial volume may be pulled down beneath the filtration compartment 220. As the full portion is pulled down, an unused portion of the remaining portion of tube 330 replaces it in filtration compartment 220. Once the filled portion of the tube 330 has completely exited the filtration compartment 220, the cover 352 for a sealing and cutting assembly 350 is closed. Closing of cover 352 causes an electrical switch (not shown) to close which causes two pairs of opposing heating elements 354 (hereinafter referred to as sealer) of the sealing and cutting assembly 350 to heat. The heating elements 354 are energized for a predetermined time interval controlled by a timer (not shown) so that the opposing sidewalls 330*a* (FIG. 4) and 330*b* (FIG. 5) on the interior of the tube 330 fuse together. The heating elements 354 must heat to a high enough temperature to penetrate the outer layer of tube 330 and still cause the inner layer of tube 330 to melt and fuse together. This is why the melting temperature of the outer layer of tube 330 must be higher than the melting temperature of the inner layer. Neccesarily this requires the heating elements 354 to not heat to a temperature exceeding the melting temperature of the outer layer. One pair of opposing heating elements 354 are located above and below a cutter or cutting blade 355 located in the cutting and sealing assembly 350. Tube 330 is sealed above and below the cutting blade 355. The seal in the tube 330 above the cutting blade 355 seals the end of the unused portion of the remaining portion of tube 330 now located in filtration compartment 220 to form a new volume for filtering and collecting particles as heretofore described. The seal in the tube 330 beneath the cutting blade 355 seals off the open end of the used portion of the tube 330 now filled with dirt particles. The cutting assembly 355 can operate either automatically or manually and cuts the tube 330 between the seals to separate the portion of the tube 330 filled with particles from the remainder of the tube 330. The filtration compartment cover is now closed 210 and the floor care appliance 10 can now be used for regular cleaning operations. This process can be repeated numerous times until the supply of compressed filtration bag material in the form of tube 330 in the container 320 is expended. At that time the container 320 is removed and replaced with a new container 320 containing a fresh supply of filtration bag material compressed therein.

Figure 5:
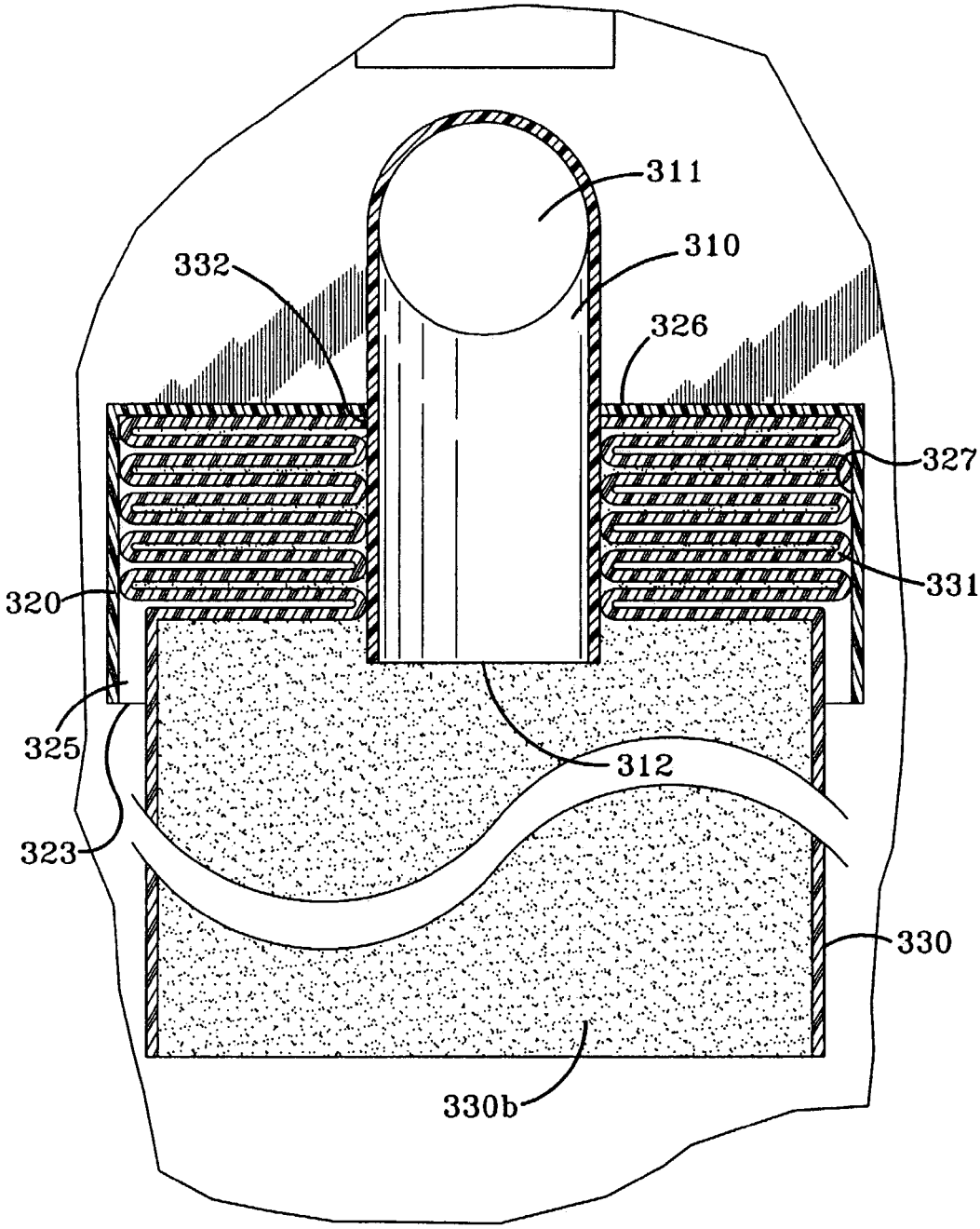
FIG. 5 shows an enlarged section view of a portion of the filtration bag changing apparatus installed in a portion of the filtration compartment of the upright vacuum cleaner of FIG. 1, according to the preferred embodiment of the present invention.

Referring now to FIG. 5, shown is a portion of the particle collecting and filtration assembly 300 disposed downwardly in the filtration compartment 220. A connecting tube 310 projects downwardly through the open top end 332 of tube 330. Connecting tube has a first end 311 fluidly connected to a dirt duct (not shown) which is further connected to suction nozzle 100. Connecting tube 310 has a second end 312 which projects downwardly into a portion of tube 330 comprising a volume for filtering and collecting dirt particles. Container 320 has a closed end 326, interior sidewall 327, and an open end 323 from which the tube 330 is fed through. Container 320 has an interior volume 325 in which the unused portion of tube 30 is compressed into in pleated layers 331. In this way, tube 330 can be uncompressed by pulling from within interior volume 325 through opening 323 into filtration compartment 220. The open end of connecting tube 311 is fluidly connected to the suction duct (not shown) through an aperture 225 in the rear of filtration compartment 220.

Figure 6:
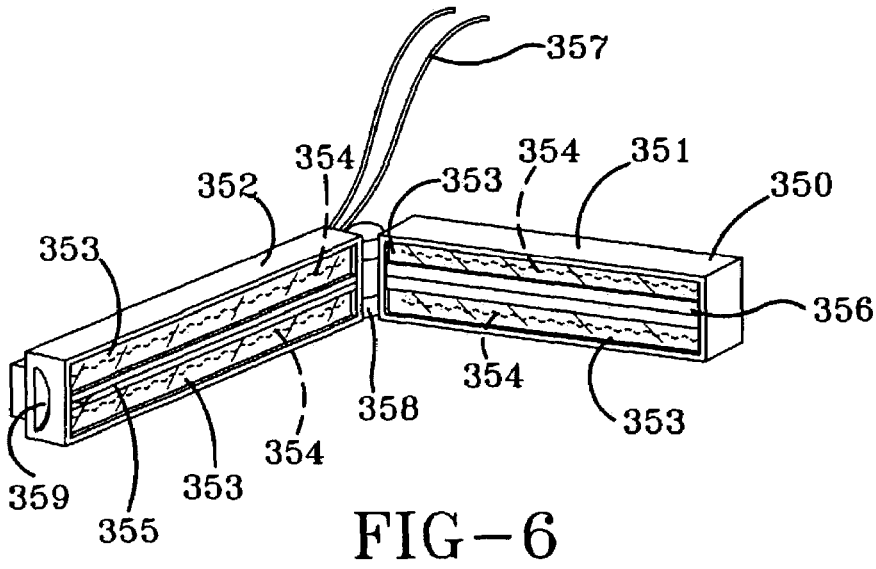
FIG. 6 shows a perspective view of a cutting and sealing assembly from the bag changing apparatus shown in FIG. 2.
Figure 7:
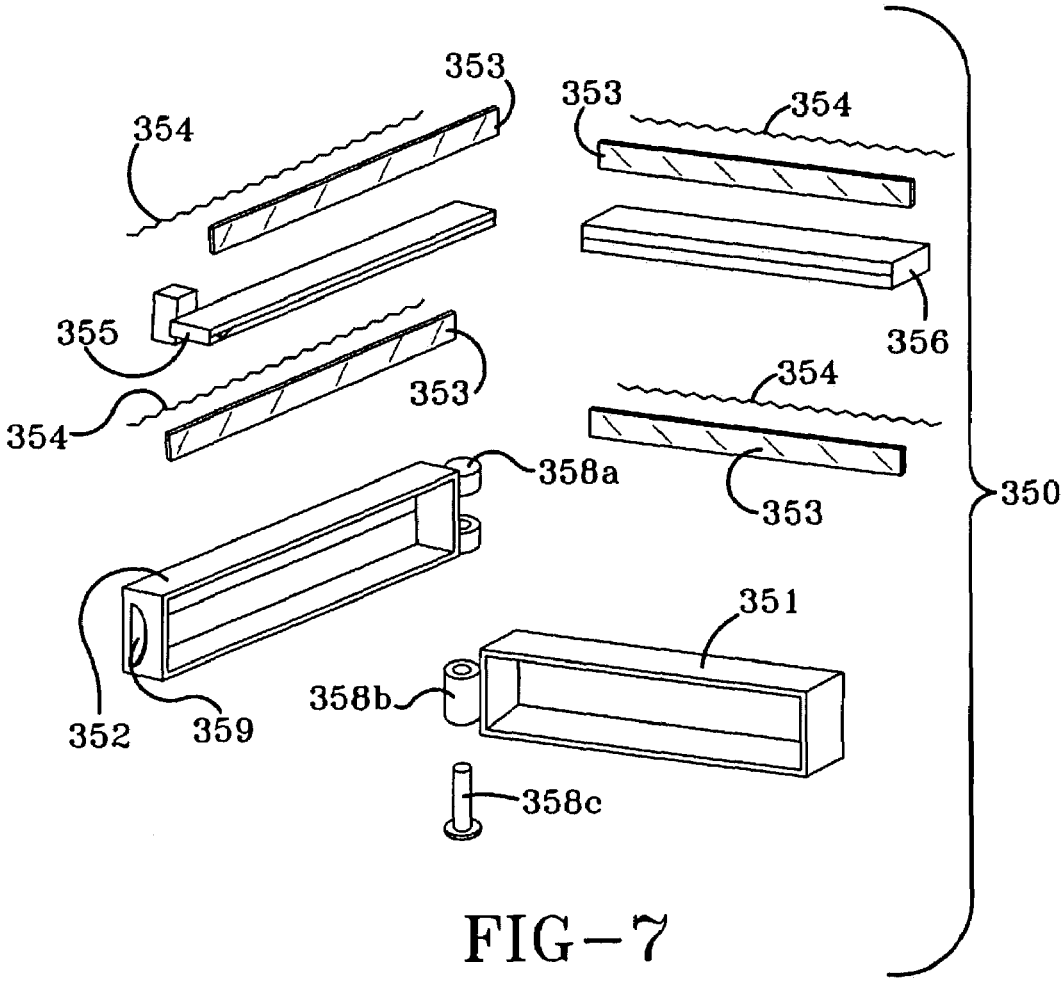
FIG. 7 shows an exploded perspective view of the cutting and sealing assembly shown in FIG. 2.

Referring now to FIGS. 6 and 7, shown is the sealing and cutting assembly 350 in the open position. The sealing and cutting assembly 350 is comprised of a rear member 351 and a cover 352. Rear member 351 and a cover 352 are pivotally connected together by a hinge 358. A pair of wire heating elements 354 are located in cover 352 wherein one heating element 354 is located above a cutting blade 355 and one heating element 354 is located beneath cutting blade 355. A pair of wire heating elements 354 are located in rear member 356 wherein one heating element 354 is located above a cutting block 356 and one heating element 354 is located beneath cutting block 356. A pair of wires 357 connect the heating elements 354 to a source of current. Hinge 358 is comprised of a first portion 358*a* connected via a pin 358*c* to a rear portion 358*b*. A heating element cover 353 is installed over each of heating elements 354 to prevent the high temperature heating elements 354 from fusing with the outer layer of tube 330. Heating element cover 353 could be made from any number of materials having a melting temperature higher than the temperature heating elements 354 operate at but at the same time readily conduct heat. One suitable material is expanded polytetrafluoroethylene commonly known as TEFLON®. A latch 359 holds sealer cover 352 securely to rear member 351 when in the shut position.

It should be clear from the foregoing that the described structure clearly meets the objects of the invention set out in the description's beginning. It should now also be obvious that many changes could be made to the disclosed structure which would still fall within its spirit and purview.

The invention claimed is:

1. A particle collecting and filtration system for a floor care appliance having at least a suction nozzle, a motor-fan assembly for generating a dirt laden airstream originating at the suction nozzle, a filtration compartment, and a suction duct, the particle collecting and filtration system comprising:

a container having an open end separated from a closed end by a sidewall;

a connector having a first end and a second end, wherein said connector extends through said closed end of said container;

a filtration media formed into a tube and having a portion thereof compressed into the container between the open end and closed end thereof, wherein said tube has a first end and a second end wherein the first end is attached to the container and said second end is initially sealed so that a volume is formed within a portion of said tube for filtering and collecting particles from said dirt laden airstream, wherein said second end of said connector resides within said volume, and said container, said connector, and said filtration media form an independent element that is selectively placed in the filtration compartment and selectively fluidly connected to the suction duct through said first end of said connector.

2. The particle collecting and filtration system of claim 1, further including a sealing and cutting assembly having a sealer and a cutter, said cutter for cutting said portion of said tube containing said volume when said volume is full of particles from a remaining portion of said tube, and said sealer for sealing said tube above said volume and a second end of said remaining portion of said tube when said volume is full of particles.

3. The particle collecting and filtration system of claim 2 wherein said sealer includes: at least one pair of opposed heating elements which become heated when an electrical current is passed therethrough, said pair of heating elements being placed in an operative position against opposing exterior sidewalls of said tube to cause opposing interior sidewalls of said tube to bond together to form a seal.

4. The particle collecting and filtration system of claim 3 further including a timer to control the amount of time said heating elements are operative.

5. The particle collecting and filtration system of claim 3 further including a heating element cover for each of said heating elements to prevent said heating elements from fusing with the exterior sidewall of said tube when operative.

6. The particle collecting and filtration system of claim 5 wherein said heating element covers are made teflon.

7. The particle collecting and filtration system of claim 2 wherein said cutter includes: a blade; a guide for directing the blade in a direction for cutting said tube; and a prime mover for moving said blade to cut said tube.

* * * * *